US006044521A

United States Patent [19]

Sebek

[11] Patent Number: 6,044,521

[45] Date of Patent: Apr. 4, 2000

[54] HYGIENIC BODY VAC

[76] Inventor: Diana Sebek, 4047 N. Whipple, Chicago, Ill. 60618

[21] Appl. No.: 08/916,312

[22] Filed: Aug. 22, 1997

[51] Int. Cl.[7] ..... A47L 9/06

[52] U.S. Cl. ..... 15/393; 15/398; 15/415.1; 15/422

[58] Field of Search ..... 15/398, 415.1, 15/422, 393

[56] References Cited

U.S. PATENT DOCUMENTS

| | | | |
|---|---|---|---|
| 1,994,869 | 3/1935 | Replogle | 15/422 |
| 2,908,933 | 10/1959 | Todd et al. | 15/415.1 X |
| 3,238,556 | 3/1966 | Martin | 15/415.1 X |
| 4,042,999 | 8/1977 | Triantafyllou | 15/422 |
| 4,265,621 | 5/1981 | McVey | 15/422 X |
| 4,459,720 | 7/1984 | Ahlf et al. | 15/398 |
| 5,305,495 | 4/1994 | Nelsen et al. | 15/415.1 X |
| 5,692,263 | 12/1997 | Sorenson | 15/422 X |

FOREIGN PATENT DOCUMENTS

| | | | |
|---|---|---|---|
| 3500106 | 7/1986 | Germany | 15/422 |

*Primary Examiner*—Chris K. Moore

[57] ABSTRACT

A vacuum attachment with disposable sleeve is provided including a vacuum mounting assembly. Further included is a disposable sleeve removably secured over an end of the mounting assembly. The sleeve has a plurality of apertures formed therein.

5 Claims, 2 Drawing Sheets

HYGIENIC BODY VAC

BACKGROUND OF THE INVENTION

1. Field of the Invention

The present invention relates to a vacuum attachment with disposable sleeve and more particularly pertains to cleaning bodily fluids, fecal matter and other debris from a person's body, bed or surrounding areas. It also includes such liquid or other debris during and/or after veterinary procedures.

2. Description of the Prior Art

The use of vacuum attachment is known in the prior art. More specifically, vacuum attachment heretofore devised and utilized for the purpose of facilitating the use of a vacuum cleaner are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,440,782; U.S. Pat. No. 5,379,483; U.S. Pat. No. Des. 350,852; U.S. Pat. No. 5,303,447; U.S. Pat. No. 5,063,635; and U.S. Pat. No. 5,074,008.

In this respect, the vacuum attachment with disposable sleeve according to the present invention substantially departs from the conventional concepts and designs of the prior art, and in so doing provides an apparatus primarily developed for the purpose of cleaning fecal matter and other debris from a bed.

Therefore, it can be appreciated that there exists a continuing need for a new and improved vacuum attachment with disposable sleeve which can be used for cleaning bodily fluids, fecal matter and other debris from a person's body, bed or surrounding areas. It also includes such liquid or other debris during and/or after veterinary procedures. In this regard, the present invention substantially fulfills this need.

SUMMARY OF THE INVENTION

In view of the foregoing disadvantages inherent in the known types of vacuum attachment now present in the prior art, the present invention provides an improved vacuum attachment with disposable sleeve. As such, the general purpose of the present invention, which will be described subsequently in greater detail, is to provide a new and improved vacuum attachment with disposable sleeve which has all the advantages of the prior art and none of the disadvantages.

To attain this, the present invention essentially comprises a vacuum mounting assembly. Such mounting assembly includes a cylindrical tube having an elongated linear portion and a short angled portion. As shown in FIG. 3, the angled portion forms an obtuse angle with the linear portion. The linear portion has an outwardly extending annular lip formed adjacent a free end thereof. A plurality of bellows are formed in the linear portion of the tube adjacent the angled portion for allowing the bending of the tube during use. As best shown in FIG. 4, a frusto-conical head is provided having a first circular open end of a first large diameter and a second circular open end of a second small diameter. The head is rotatably coupled to an end of the angled portion of the vacuum mounting assembly. Next provided is a disposable sleeve including a circular disk-shaped plate with the larger diameter. As shown in FIG. 2A, the plate has an upper convex surface and a lower planar surface. The plate further has a plurality of apertures formed therein. The sleeve further includes a flexible sheath with a first end coupled about a periphery of the disk-shaped plate. A second open end of the sleeve is equipped with an adhesive lining a periphery thereof. By this structure, the sleeve may be positioned about the head with the disk-shaped plate situated over the first circular open end of the head. Further in such orientation, the adhesive of the sleeve adheres to the angled portion of the vacuum mounting assembly such that the lip of the vacuum assembly may be releasably connected with a hose of a vacuum. In use, the vacuum attachment may be utilized to clean bodily fluids, fecal matter and other debris from a person's body, bed or surrounding areas. It also includes such liquid or other debris during and/or after veterinary procedures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vacuum attachment with disposable sleeve which has all the advantages of the prior art vacuum attachment and none of the disadvantages.

It is another object of the present invention to provide a new and improved vacuum attachment with disposable sleeve which may be easily and efficiently manufactured and marketed.

It is a further object of the present invention to provide a new and improved vacuum attachment with disposable sleeve which is of a durable and reliable construction.

An even further object of the present invention is to provide a new and improved vacuum attachment with disposable sleeve which is susceptible of a low cost of manufacture with regard to both materials and labor, and which accordingly is then susceptible of low prices of sale to the consuming public, thereby making such vacuum attachment with disposable sleeve economically available to the buying public.

Still yet another object of the present invention is to provide a new and improved vacuum attachment with disposable sleeve which provides in the apparatuses and methods of the prior art some of the advantages thereof, while simultaneously overcoming some of the disadvantages normally associated therewith.

Still another object of the present invention is to clean bodily fluids, fecal matter and other debris from a person's body, bed or surrounding areas. It also includes such liquid or other debris during and/or after veterinary procedures.

Lastly, it is an object of the present invention to provide a new and improved vacuum attachment with disposable sleeve including a vacuum mounting assembly. Further included is a disposable sleeve removably secured over an end of the mounting assembly. The sleeve has a plurality of apertures formed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
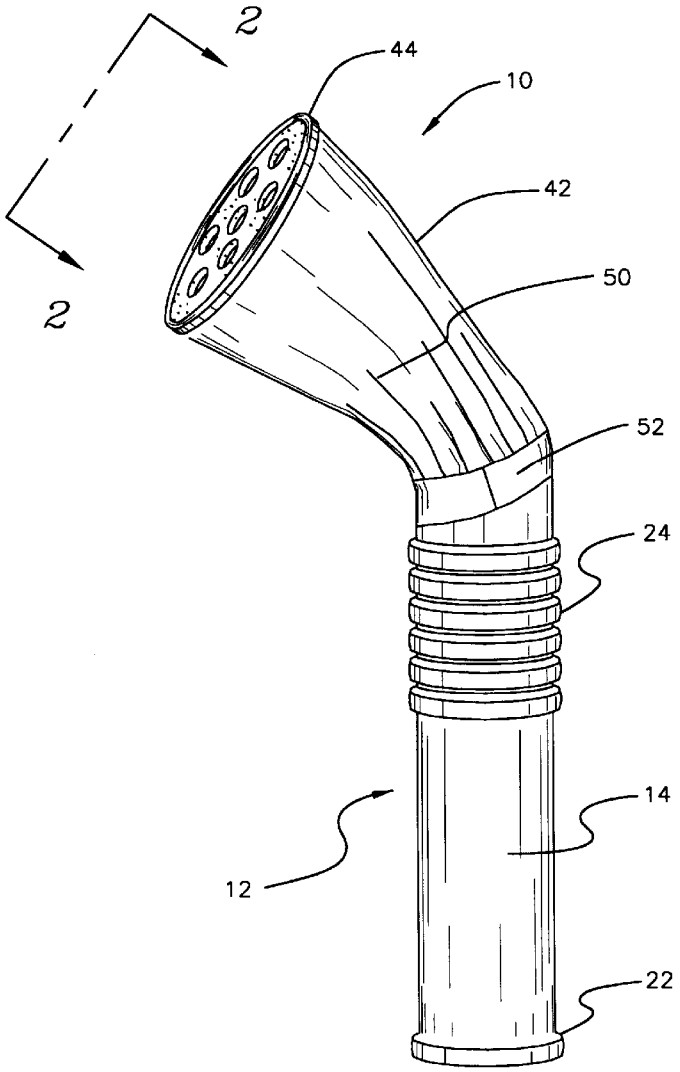
FIG. 1 is a perspective illustration of the preferred embodiment of the vacuum attachment with disposable sleeve constructed in accordance with the principles of the present invention.

With reference now to the drawings, and in particular to FIG. 1 thereof, a new and improved vacuum attachment with disposable sleeve embodying the principles and concepts of the present invention and generally designated by the reference numeral 10 will be described.

The present invention, the new and improved vacuum attachment with disposable sleeve, is comprised of a plurality of components. Such components in their broadest context include a vacuum mounting assembly, a head, and a sleeve. Such components are individually configured and correlated with respect to each other so as to attain the desired objective.

Figures 3, 4:
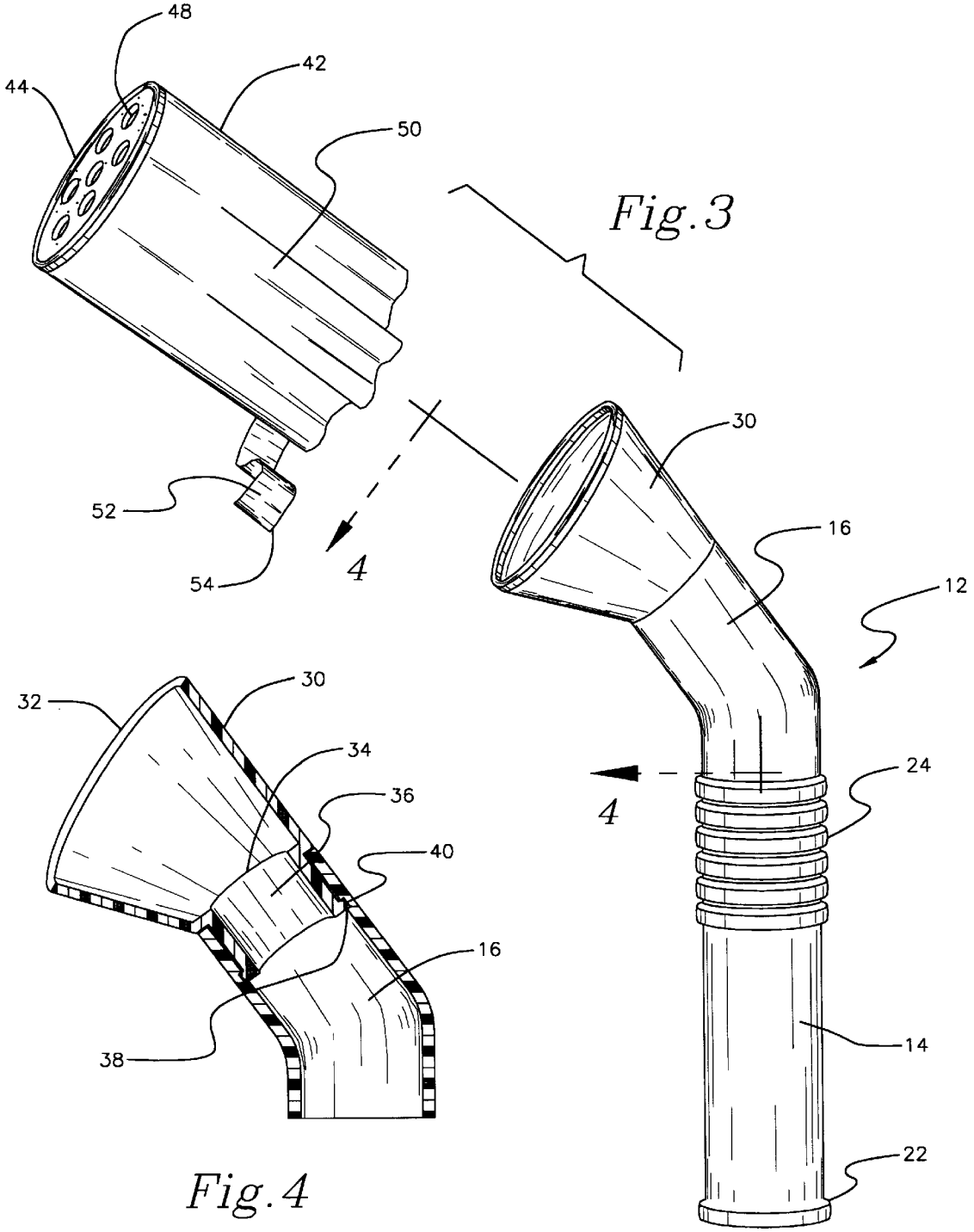
FIG. 3 is an exploded view of the present invention.
FIG. 4 is a cross-sectional view of the interconnection of the head and vacuum mounting assembly of the present invention.

More specifically, it will be noted that the system 10 of the present invention includes a rubber vacuum mounting assembly 12. Such mounting assembly includes a cylindrical tube having an elongated linear portion 14 and a short angled portion 16. Ideally, the linear portion constitutes over ¾ the length of the tube. As shown in FIG. 3, the angled portion forms an obtuse angle of about 120 degrees with the linear portion.

For facilitating the removable attachment of the tube with a suction hose of a vacuum cleaner, the linear portion has an outwardly extending annular lip 22 formed adjacent a free end thereof. A plurality of bellows 24 are formed in the linear portion of the tube adjacent the angled portion for allowing the bending of the tube during use. As shown in FIGS. 1 & 3, the bellows extend a length that is ¼ of the total length of the tube.

As best shown in FIG. 4, a frusto-conical head 30 is provided having a first circular open end 32 of a first large diameter and a second circular open end 34 of a second small diameter. The large diameter is preferably 3 and ½ inches and the small diameter is 2 inches. The head is rotatably coupled to an end of the angled portion of the vacuum mounting assembly. To accomplish such coupling, the head has a cylindrical portion 36 extending from the second circular open end thereof. Note FIG. 4. Such cylindrical portion has a radially extending flange 38 which is rotatably engaged within an annular detent 40 formed in an interior surface of a central extent of the angled portion of the tube. It is also shown in FIG. 4 that the head is configured such that, in one orientation, an upper surface of the angled portion remains in collinear relationship with the head and a lower surface thereof forms an angle with the head. As such, the first and second open ends of the generally frusto-conical head are not in coaxial alignment.

Figure 2:
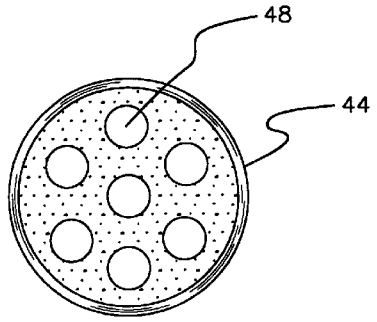
FIG. 2 is a top view of the disk-shaped plate of the sleeve.
Figure 2A:
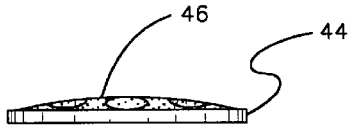
FIG. 2A is a side view of the disk-shaped plate of FIG. 2.
Figure 2B:
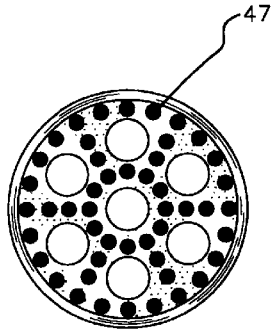
FIG. 2B is a top view of an alternate embodiment of the disk-shaped plate of the present invention.
Figure 2C:
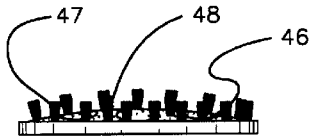
FIG. 2C is a side view of the alternate embodiment shown in FIG. 2B.

Next provided is a disposable sleeve 42 including a circular disk-shaped plate 44 with the larger diameter. Such plate is ideally constructed from ½ inch thick porous foam. As shown in FIG. 2A, the plate has an upper convex surface 46 and a lower planar surface. The plate further has seven apertures 48 formed therein. The apertures constitute between ⅓ and ½ the area of the disk-shaped plate. In an alternate embodiment, the plate is further equipped with a hair-like projections 47 to aid in removing debris from body surfaces. Note FIGS. 2B & 2C.

The sleeve further includes a flexible sheath 50 with a first end coupled about a periphery of the disk-shaped plate. A second open end of the sleeve is equipped with an adhesive 52 lining a periphery thereof. In its packaged form, the adhesive is constructed in the form of strip 54 with only a first end coupled to the sleeve and a film formed over the adhesive. By this structure, the sleeve may be positioned about the head with the disk-shaped plate situated over the first circular open end. Further in such orientation, the film of the adhesive strip of the sleeve may be removed such that the strip may be tightly wound and adhered to the sleeve such that it remains secured to the angled portion of the vacuum mounting assembly. As an option, the adhesive may be also adhered to the vacuum mounting assembly itself. As such, the lip of the vacuum assembly may be releasably connected with a hose of a vacuum and the vacuum attachment may be utilized to clean debris from a bed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved vacuum attachment with disposable sleeve comprising, in combination:

a vacuum mounting assembly including a cylindrical tube having an elongated linear portion and a short angled portion which forms an obtuse angle with the linear portion, the linear portion having an outwardly extending annular lip formed adjacent a free end thereof and a plurality of bellows formed therein adjacent the angled portion for allowing the bending of the tube;

a frusto-conical head having a first circular open end of a first large diameter and a second circular open end of a second small diameter rotatably coupled to an end of the angled portion of the vacuum mounting assembly; and a disposable sleeve including a circular disk-shaped plate with the larger diameter, the plate having an upper convex surface and a lower planar surface, the plate further having a plurality of aperture formed therein, the sleeve further including a flexible sheath with a first end coupled about a periphery of the disk-shaped plate and a second open end with an adhesive lining a periphery thereof, whereby the sleeve may be positioned about the head with the disk-shaped plate situated over the first circular open end of the head and with the adhesive adhering to the angled portion of the vacuum mounting assembly such that the lip of the vacuum assembly may be releasably connected with a hose of a vacuum and the vacuum attachment may be utilized to clean debris from a bed.

2. A vacuum attachment with disposable sleeve comprising: a vacuum mounting assembly including a tube;

and a disposable sleeve removably secured over an end of the tube, the sleeve having a plurality of apertures formed therein;

the sleeve including a circular disk-shaped plate, wherein the plate has the apertures formed therein.

3. A vacuum attachment with disposable sleeve as set forth in claim 2 wherein the plate has an upper convex surface.

4. A vacuum attachment with disposable sleeve comprising:

a vacuum mounting assembly including a tube;

and a disposable sleeve removably secured over an end of the tube, the sleeve having a plurality of apertures formed therein and;

a frusto-conical head rotatable coupled to the tube of the vacuum mounting assembly.

5. A vacuum attachment comprising:

a vacuum mounting assembly including a tube; and a disposable plate removably coupled to the tube, wherein the plate has at least one aperture formed therein;

the plate having a plurality of projections formed thereon to aid in removing debris from body surfaces.

* * * * *